US005706587A

United States Patent [19]

Lehtinen et al.

[11] Patent Number: 5,706,587

[45] Date of Patent: Jan. 13, 1998

[54] APPARATUS FOR DRYING A FIBRE WEB

[75] Inventors: Jukka Lehtinen; Paavo Rautakorpi; Jari Ilomäki, all of Tampere, Finland

[73] Assignee: Valmet Corporation, Helsinki, Finland

[21] Appl. No.: 746,234

[22] Filed: Nov. 7, 1996

[30] Foreign Application Priority Data

Nov. 17, 1995 [FI] Finland ..... 955565

[51] Int. Cl.[6] ..... F26B 13/26

[52] U.S. Cl. ..... 34/71; 34/95

[58] Field of Search ..... 34/355, 421, 422, 34/71, 94, 95, 110, 116, 117, 120, 123, 613, 619, 620, 624, 636; 162/206, 207, 375, 358.3, 358.5; 100/309, 310

[56] References Cited

U.S. PATENT DOCUMENTS

| | | | |
|---|---|---|---|
| 4,112,586 | 9/1978 | Lehtinen . | |
| 4,461,095 | 7/1984 | Lehtinen . | |
| 4,719,707 | 1/1988 | Klapp | 34/94 |
| 4,899,461 | 2/1990 | Lehtinen . | |
| 4,958,444 | 9/1990 | Rautakorpi et al. | 34/71 |
| 5,553,392 | 9/1996 | Hanaya | 34/115 |
| 5,594,997 | 1/1997 | Lehtinen | 34/95 |
| 5,619,806 | 4/1997 | Warren | 34/331 |

FOREIGN PATENT DOCUMENTS 59439 4/1981 Finland .

*Primary Examiner*—John M. Sollecito
*Assistant Examiner*—Steve Gravini
*Attorney, Agent, or Firm*—Ladas & Parry

[57] ABSTRACT

An apparatus for drying a fibre web, the apparatus comprising two endless bands that conduct heat well and are impermeable to air, which bands are arranged to run part of the way parallel with each other, the first band (1) being heated and the second band (2*a*) being cooled and the fibre web (3) being conducted together with at least one fabric between the bands (1, 2*a*) in such a way that the fibre web is in contact with the heated band (1) and the fabric is between the fibre web and the cooled band (2*a*). The invention comprises additionally a third band (2*b*) that conducts heat well and is impermeable to air, which band is located after the second band (2*a*) in the travel direction of the bands and forms together with the first band (1) a second drying zone.

13 Claims, 4 Drawing Sheets

APPARATUS FOR DRYING A FIBRE WEB

Figure 1:
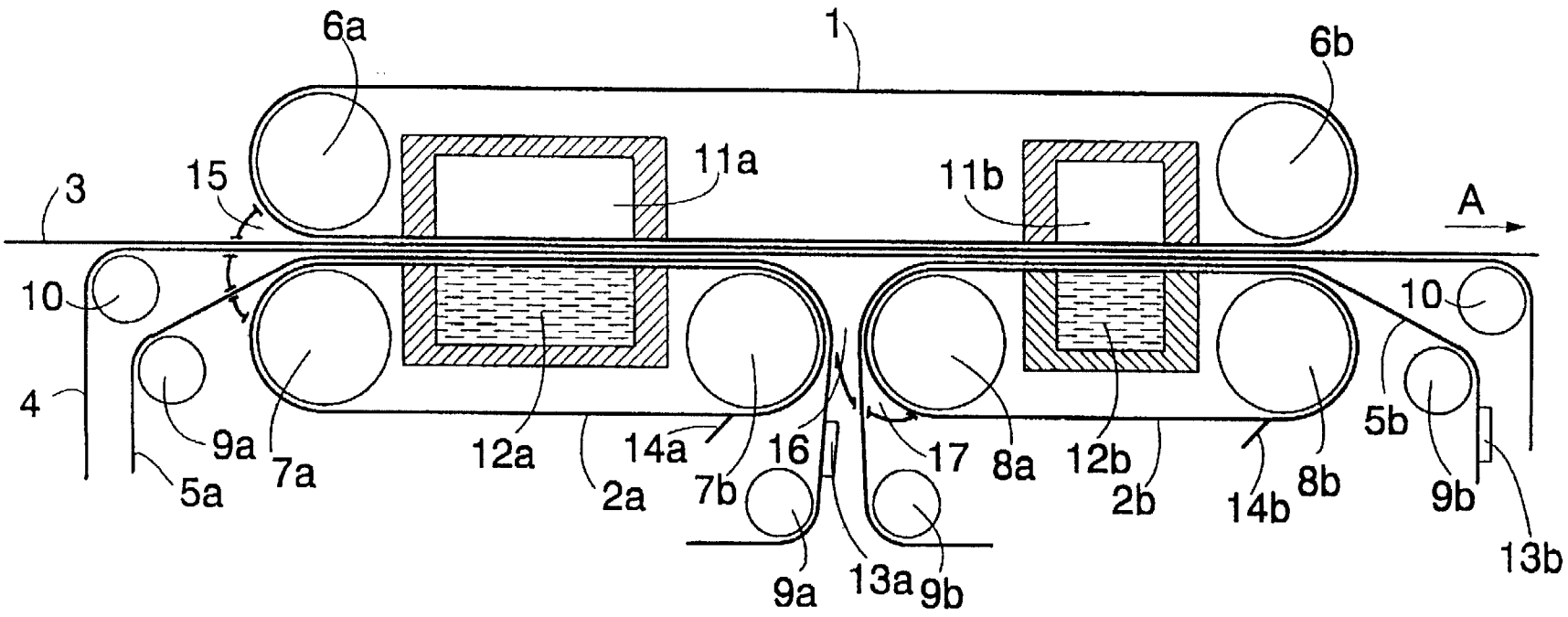

The invention relates to an apparatus for drying a fibre web, the drying apparatus comprising a first and a second endless band that are impermeable to air and conduct heat well, first turning rolls, around which the first band is arranged to turn, and second turning rolls, around which the second band is arranged to turn; the first and the second band being arranged to run part of the way parallel with each other so that they form a drying zone between them, the first band being heated and the second band being cooled, and a fibre web and at least one fabric that forms an endless loop being conducted between the bands so that the fibre web is in contact with the heated first band and the fabric is between the fibre web and the cooled second band, as well as guide rolls for guiding endless fabrics.

Finnish Patent 59439 discloses a method of drying a fibre web. In this method, the fibre web is conducted between two endless metal bands, both being arranged to run around turning rolls at the opposite ends of the apparatus. On the sides facing each other, the bands run parallel with each other and both the fibre web and one fabric or more fabrics, such as a felt or a wire, at the same speed between the bands in such a way that the fibre web is in contact with one band and the felts or wires are between the fibre web and the second band. To dry the fibre web, the band bearing against it is heated, due to which the water in the fibre web evaporates and moves towards the felts or wires. Simultaneously, the band facing the felts or wires is cooled, due to which the water steam cools to a condensate onto the band and thus allows a steam flow from the fibre web towards the cooled band. The condensate formed on the cooled band is removed after the drying zone of the apparatus in such a way that there is substantially no water on the surface of the lower band at the inlet end of the apparatus.

During the drying procedure, the amount of condensate accumulated on the cooled band increases from the inlet end of the apparatus towards the outlet end of the apparatus. This influences naturally to some extent the capability of the apparatus to move steam from the fibre web towards the cooled band. Especially when thick webs containing plenty of water are dried, the drying apparatus can become rather long, which increases the costs of the apparatus as far as machine and building investments are concerned.

The object of the present invention is to provide a drying apparatus that is capable of drying a fibre web more efficiently, to make it possible to use shorter drying apparatuses and to achieve a better drying result compared with previous apparatuses. The drying apparatus according to the invention is characterized in that the second band is arranged to run parallel with the first band only part of the length between the turning rolls of the first band, that the drying apparatus comprises a third endless band that is impermeable to air, conducts heat well and is arranged to turn around third turning rolls and to run after the second band part of the way parallel with the first band to form together with it a drying zone, and that it comprises a first fabric, which is conducted with the fibre web through the entire drying apparatus.

The essential idea of the invention is that two or more cooled bands are used for drying a fibre web, the bands being positioned one after another in the longitudinal direction of the drying apparatus and each band being freed separately from the condensate accumulated on the surface of the band. In this way, it is possible to decrease the effect of the condensate weakening the drying so that the drying of the web will take place efficiently.

Figure 2:
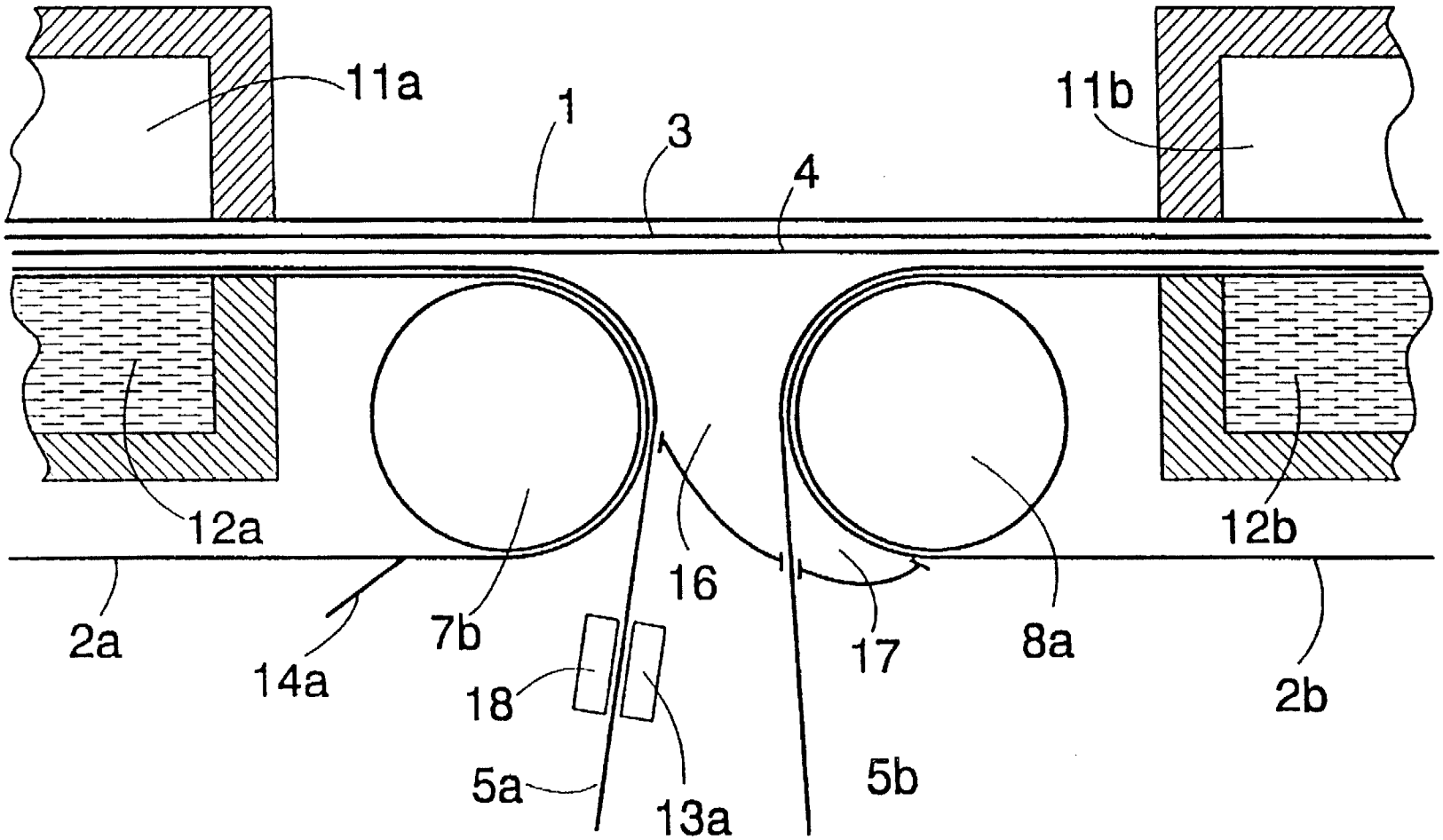
Figure 3:
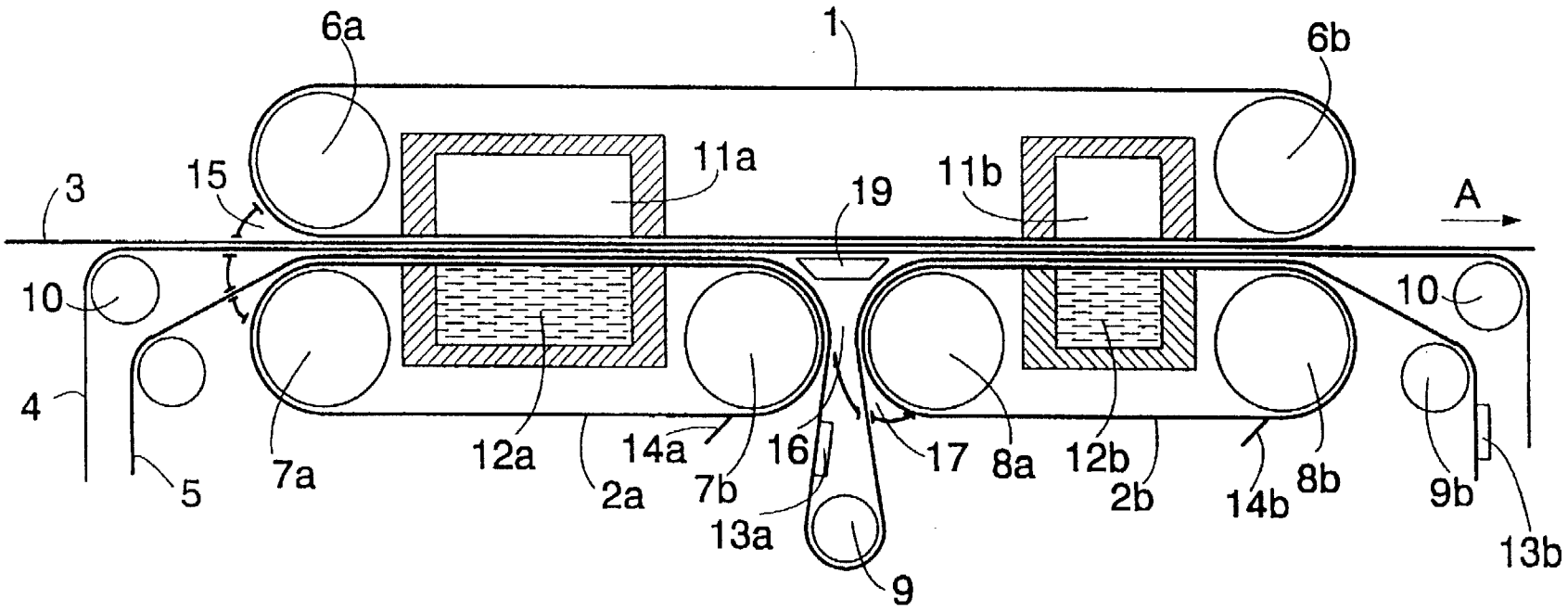
Figure 4:
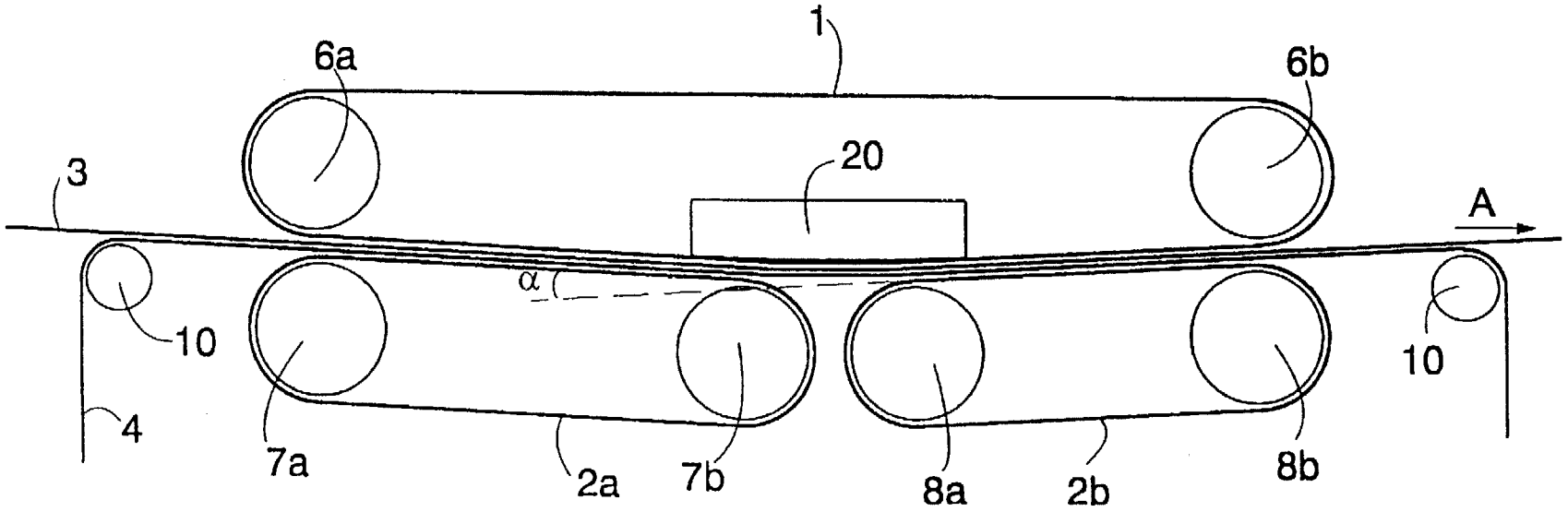

The invention will be described in further detail in the attached drawings, where FIG. 1 shows a schematic side view of a drying apparatus according to the invention, FIG. 2 shows schematically a detail of a point where cooled bands are changed in the apparatus according to FIG. 1, FIG. 3 shows a schematic side view of another drying apparatus according to the invention and FIG. 4 shows a schematic general view of a third embodiment of the drying apparatus according to the invention.

FIG. 1 shows a drying apparatus according to the invention, the apparatus comprising endless drying bands that conduct heat well and are impermeable to air, i.e. a first band 1 as well as a second band **2*a* and a third band 2*b*; the first band 1, the second and the third band 2*a* and 2*b* being located substantially upon each other so that the second band 2*a* and the third band 2*b* are mutually one after another. The bands are arranged in such a way that the first and the second band as well as the first and the third band, respectively, run part of the way parallel with each other so that they form two by two a drying zone between themselves. A fibre web 3 located against the first band runs between the surfaces of the bands 1 and, on the other hand, the bands 2*a* and 2*b*, facing each other, and a first fabric 4, such as a felt or a wire, bearing against the fibre web runs between the fibre web 3 and the second bands 2*a* and 2*b*. There are additional fabrics, i.e. preferably a coarser second and third fabric 5*a* and 5*b* between the fabric 4 and the second and the third band 2*a* and 2*b*. The first band 1 is arranged to turn around first turning rolls 6*a* and 6*b* and the second band 2*a* is arranged to turn around second turning rolls 7*a* and 7*b*, respectively, and the third band 2*b* around third turning rolls 8*a* and 8*b*. The coarse fabrics 5*a* and 5*b* are guided by means of guide rolls 9*a* and 9*b* and the fabric 4 by means of guide rolls 10**, respectively.

To dry the fibre web, heating chambers **11*a* and 11*b* are arranged against the first band, into which chambers is fed hot pressurized steam heating the first band 1. On the opposite sides of the heating chambers 11*a* and 11*b*, inside the second and the third band, there are cooling chambers 12*a* and 12*b*, into which is fed cooling medium, such as water or the like, so that the second and the third band 2*a* and 2*b* remain cool. Then the heat of the first band makes the water contained in the fibre web 3 evaporate and move through the fabric 4 to the coarse fabrics 5*a* and 5*b* and condensate on the surface of the second and the third band 2*a* and 2*b*, respectively. To remove water from the fabrics 5*a* and 5*b*, suction boxes 13*a* and 13*b* are positioned against them, the boxes sucking air through the fabrics and thus the water out of them. Further, the condensed water is removed from the surface of the second and the third band by means of doctor blades 14*a* and 14*b*, for instance. Subsequently, the bands and the fabrics return, in order to turn to run parallel with the first band again. The heating chambers 11*a* and 11*b* and the cooling chambers 12*a* and 12*b***, respectively, are sealed with seals against the surface of the corresponding band in a manner known per se, in order to prevent the pressurized medium therein, such as steam or water, from flowing outside the chamber. A sealing like this is generally known per se and not essential for the invention, due to which it is not described here any further.

Because a pressure differing from the surrounding pressure is generally produced between the bands 1 and the bands **2*a* and 2*b* when the fibre web becomes hot and the steam is cooling, there are seals between the bands on the sides thereof, which seals prevent the air from flowing between the bands or the steam from flowing out of there. Such a sealing between the bands is generally known per se and not essential for the invention, due to which it is not described here any further. Moreover, the inlet end of the apparatus comprises in a manner known per sea steam exhaust chamber 15 exhausting the air contained in the fibre web 3 and the fabrics 4 and 5a by feeding steam through them, whereby air molecules are replaced by steam molecules. Further, there is a steam chamber 16 in the space between the second and the third band, which chamber has a pressure somewhat higher than the indoor air pressure so that no air can flow into this space. In addition, when the third fabric 5b comes into the steam chamber 16, steam flows through the fabric into an air exhaust space 17 between the fabric and the third band, due to which not even the third band brings air into the drying zone. Hot steam can also be fed into the steam chamber 16** separately to keep the pressure therein as desired and to intensify the air exhaust.

The fabric 4 runs through the space between the bands 2a and 2b and supports the fibre web 3 during this time. Because the fabric 4 and the fibre web 3 are not supported from below at this point, no pressurized heating chamber is used at the corresponding point above either, but the heating chambers 11a and 11b are positioned in such a way that the cooling chambers 12a and 12b between the second and the third band 2a and 2b are located essentially opposite to the heating chambers 11a and 11b.

FIG. 2 shows schematically a detail of a drying apparatus of the invention at a point between the second and the third band more accurately. Reference numerals used are in accordance with FIG. 1.

As appears from FIG. 2, the second band 2a and the second fabric 5a part from each other after the turning rolls 7b, a doctor blade 14a scratching from the surface of the band 2a the condensate accumulated thereon. Correspondingly, there is a suction box 13a on one side of the second fabric 5a, which box sucks water therefrom, and on the other side, there can additionally or instead be a blow box 18 blowing air through the fabric to remove water from it. Between the fabrics 5a and 5b, there is a steam chamber 16, into which can be fed steam in such a way that the pressure therein remains higher than the pressure of the surrounding room. Steam flows from this chamber through the third fabric 5b into an air exhaust space 17, from where air is sucked all the time so that the fabric 5b moves around the roll 8a substantially air-free.

FIG. 3 shows a schematic side view of another drying apparatus according to the invention. In this embodiment, not two separate additional fabrics run around the second band 2a and the third band 2b, but one additional fabric 5, which forms a closed loop around the two bands 2a and 2b. To remove water from the additional fabric, the fabric is conducted to run around a separate guide roll 9 between the bands 2a and 2b and to return from between the bands 2a and 2b to run between the band 2b and the first fabric 4. Here, a suction box 13a is arranged against the additional fabric 5, by which box water is sucked from the fabric. If desired, a blow box can be used in the manner shown in FIG. 2, either together with the suction box 13a or without it. Likewise, to remove the water from the additional fabric 5, another suction box and air blow or steam blow box can be used before the additional fabric returns into contact with the third band 2b. Further, when the additional fabric 5 parts from the fibre web after the third band, water is removed from it in the manner shown in FIG. 1, for instance, so that this fabric may contain as little water as possible when it comes to the inlet end of the drying apparatus. Besides one common additional fabric, additional fabrics can, of course, also be used as a fabric forming a closed loop around the second and the third band 2a, 2b or around either one only, as shown in FIG. 2. FIG. 3 shows also a support member 19 bearing against the first fabric in the steam chamber 16, which support member can be for instance a foil box or a shoe, a suction box or the like, supporting the first fabric 4 and through that the fibre web 3.

FIG. 4 shows a schematic general side view of a third embodiment of the drying apparatus according to the invention. For the sake of clarity, everything that has been explained earlier in connection with the other figures has been excluded from this figure, if not associated with this embodiment. In this embodiment, the second band 2a and the third band 2b are arranged to form an angle with each other, with the turning rolls 7a, 7b and 8a, 8b mounted in such a way that the midmost turning rolls 7b and 8a are lower than the outermost turning rolls 7a and 8b in the height direction of the apparatus. Then the bands 1 and 2a as well as 1 and 2b, respectively, run a distance parallel with each other, but the bands 2a and 2b form an angle with each other. Between the rolls 7b and 8a, the drying apparatus comprises a support member 20 bearing against the surface of the band 1, which support member can be, as shown in the figure, a gently curved shoe, roll or the like, around which the band 1 runs and against which the band 1, the fibre web 3 and the first fabric 4 are bearing. In this embodiment, the fibre web 3 can be supported by adjusting the tightness of the first fabric 4 suitably.

The invention has been described in the above specification and in the drawings only by way of example and it is by no means restricted to that. Various known seal and air exhaust solutions are available for the implementation of the invention without being of essential significance for the very invention. Likewise, water removal from the fabrics, i.e. felts or wires, can take place in various ways. Also more than two wires or felts on each other can be used and the number and structure of the wires or felts running around the second band and the third band may be different. Likewise, heating the first band and cooling the second and the third band may be performed differently in manners known per se. If desired, even three or more cooling bands can be used instead of two cooling bands according to which kind of fibre web is dried and in what way it shall be dried.

We claim:

1. An apparatus for drying a fibre web, the drying apparatus comprising a first and a second endless band that are impermeable to air and conduct heat well, first turning rolls, around which the first band is arranged to turn, and second turning rolls, around which the second band is arranged to turn, the first and the second band being arranged to run part of the way parallel with each other so that they form a drying zone between them, the first band being heated and the second band being cooled, and a fibre web and at least one fabric that forms an endless loop being conducted between the bands so that the fibre web is in contact with the heated first band and the fabric is between the fibre web and the cooled second band, as well as guide rolls for guiding endless fabrics, wherein the second band is arranged to run parallel with the first band only part of the length between the turning rolls of the first band, the drying apparatus comprises a third endless band that is impermeable to air, conducts heat well and is arranged to turn around third turning rolls and to run after the second band part of the way parallel with the first band to form together with it a drying zone, and the apparatus comprises a first fabric, which is conducted with the fibre web through the entire drying apparatus.

2. A drying apparatus according to claim 1, wherein the apparatus comprises an additional fabric located between at least one cooled band and the first fabric and forming a closed loop around at least one cooled band, and means for removing condensed water from the additional fabric.

3. A drying apparatus according to claim 2, wherein the apparatus comprises a second fabric located between the second band and the first fabric and forming a closed loop around the second band and means for removing the condensed water from the second fabric.

4. A drying apparatus according to claim 2, wherein the apparatus comprises a third fabric located between the third band and the first fabric and forming a closed loop around the third band and means for removing the condensed water from the third fabric.

5. A drying apparatus according to claim 2, wherein the apparatus comprises one additional fabric located between the second band and the third band as well as the first fabric and forming a closed loop both around the second and the third band and the additional fabric is arranged to run between the second and the third band through separate water removal means.

6. A drying apparatus according to claim 1, wherein, for cooling the second and the third band, respectively, cooling chambers are sealed against the surface of the bands, inside the loops formed by the bands, into which chambers is fed water required for cooling the bands, and heating chambers located opposite to the cooling chambers and facing the cooling chambers are sealed against the surface of the first band, inside the loop formed by the first band, the pressure prevailing inside the heating chambers being essentially the same as the pressure of the cooling chambers located opposite to the heating chambers.

7. A drying apparatus according to claim 1, wherein a space remaining between the second and the third band is formed into a steam chamber, the pressure therein being higher than the pressure of the surrounding space.

8. A drying apparatus according to claim 7, wherein steam having a pressure higher than the pressure of the surrounding space is conducted into the steam chamber so that air is not able to flow into the drying zone of the drying apparatus.

9. A drying apparatus according to claim 7, wherein an air exhaust chamber is formed between the additional fabric, located between the third band and the first fabric, and the third band on that side of the additional fabric that is opposite to the steam chamber, air being sucked from the air exhaust chamber so that steam flows from the steam chamber through said additional fabric into the air exhaust chamber.

10. A drying apparatus according to claim 1, wherein the apparatus comprises means for removing the water condensed on the surface of the second and the third band.

11. A drying apparatus according to claim 1, wherein the means for removing water from each additional fabric comprise at least one of the suction boxes bearing against each fabric, by which suction box air and together with it water is sucked from the fabric into the respective suction box.

12. A drying apparatus according to claim 1, wherein support members bearing against the surface of the first fabric or the additional fabric for supporting said fabric and through that the fibre web are located between the second and the third band.

13. A drying apparatus according to claim 1, wherein the second and the third band are arranged to run parallel with the first band, but to form an angle with each other so that the second turning roll of the second band and the first turning roll of the third band, respectively, are located at a distance from the level between the outermost turning rolls of said bands away from the first band and the drying apparatus comprises a support member located between the midmost turning rolls and bearing against the surface of the first band that faces away from the fibre web, such as a shoe or the like, along the surface of which the first band turns and towards which the band, the fibre web and the first fabric are pressed.

* * * * *